US008328653B2

(12) United States Patent
Lock

(10) Patent No.: US 8,328,653 B2
(45) Date of Patent: Dec. 11, 2012

(54) OBJECT LOCATION AND MOVEMENT DETECTION SYSTEM AND METHOD

(75) Inventor: Timothy J. Lock, Ann Arbor, MI (US)

(73) Assignee: Playdata, LLC, Ann Arbor, MI (US)

( * ) Notice: Subject to any disclaimer, the term of this patent is extended or adjusted under 35 U.S.C. 154(b) by 211 days.

(21) Appl. No.: 12/678,826

(22) PCT Filed: Sep. 19, 2008

(86) PCT No.: PCT/US2008/077010

§ 371 (c)(1),
(2), (4) Date: Mar. 18, 2010

(87) PCT Pub. No.: WO2009/039367

PCT Pub. Date: Mar. 26, 2009

(65) Prior Publication Data

US 2010/0210377 A1 Aug. 19, 2010

Related U.S. Application Data

(60) Provisional application No. 60/974,185, filed on Sep. 21, 2007.

(51) Int. Cl.
*A63B 57/00* (2006.01)
*A63B 69/36* (2006.01)

(52) U.S. Cl. ..... 473/199; 473/409

(58) Field of Classification Search ..... 473/151, 473/199, 401, 219, 198
See application file for complete search history.

(56) References Cited

U.S. PATENT DOCUMENTS

| | | | | |
|---|---|---|---|---|
| 4,063,259 | A | 12/1977 | Lynch et al. | |
| 4,136,387 | A | 1/1979 | Sullivan et al. | |
| 4,158,853 | A | 6/1979 | Sullivan et al. | |
| 4,160,942 | A | 7/1979 | Lynch et al. | |
| 4,375,887 | A | 3/1983 | Lynch et al. | |
| 6,241,622 | B1 | 6/2001 | Gobush et al. | |
| 6,359,647 | B1 | 3/2002 | Sengupta et al. | |
| 6,488,591 | B1 | 12/2002 | Gobush et al. | |
| 6,514,081 | B1 * | 2/2003 | Mengoli | 434/252 |
| 6,585,609 | B2 | 7/2003 | Bays et al. | |
| 6,697,820 | B1 | 2/2004 | Tarlie | |
| 7,010,550 | B2 | 3/2006 | Tarlie | |
| 7,095,312 | B2 | 8/2006 | Erario et al. | |
| 7,118,498 | B2 | 10/2006 | Meadows et al. | |
| 7,143,639 | B2 | 12/2006 | Gobush | |
| 7,170,592 | B2 | 1/2007 | Mydlack et al. | |
| 7,175,177 | B2 | 2/2007 | Meifu et al. | |
| 2002/0155896 | A1 | 10/2002 | Gobush et al. | |
| 2004/0032970 | A1 * | 2/2004 | Kiraly | 382/103 |
| 2004/0142772 | A1 | 7/2004 | Asakura | |
| 2006/0025229 | A1 | 2/2006 | Mahajan et al. | |
| 2006/0166737 | A1 | 7/2006 | Bentley | |

(Continued)

*Primary Examiner* — Peter DungBa Vo
*Assistant Examiner* — Damon Pierce
(74) *Attorney, Agent, or Firm* — Fraser Clemens Martin & Miller LLC; William J. Clemens

(57) ABSTRACT

A system and method for detecting object location and movement utilizes a first viewing area (40) observed by a first camera (42) cooperating with a light (43) and a second camera (44) cooperating with a light (45). A third camera (46) can be added to observe a second viewing area (47) encompassing the first viewing area (40). The first camera (42) acquires images at time spaced points (51) and (53) along a first trajectory line (55). The second camera (44) acquires images at time spaced points (52) and (54) along a second trajectory line (56). This information is combined to generate the 3-D trajectory line (50) of the object.

7 Claims, 4 Drawing Sheets

U.S. PATENT DOCUMENTS

2007/0010342 A1 1/2007 Sato et al.
2007/0026974 A1 2/2007 Marty et al.
2007/0026975 A1 2/2007 Marty et al.
2007/0032143 A1 2/2007 Short
2007/0049393 A1 3/2007 Gobush
2007/0060410 A1 3/2007 Gobush

* cited by examiner

OBJECT LOCATION AND MOVEMENT DETECTION SYSTEM AND METHOD

BACKGROUND OF THE INVENTION

The present inventions are directed to using machine vision to locate balls, clubs/bats and person's using the clubs/bats.

Improving an athlete's opportunity to succeed may include providing approximate measurements of the athlete's movements and analyzing these measurements in light of general statistical data. Currently, an athlete, such as a golfer, may have their golf swing analyzed using one of many approaches involving cameras and lights to capture launch data for the golf ball (velocity, launch angle, spin) and the club data. Several disadvantages of these current prior art systems are overcome by the present invention. Specifically, none of these prior art methods and apparatuses provides the system which we have developed for several reasons:

1. The ball spin is found using a pattern of targets on the ball with special optical properties. (US Pat App 20070060410) Processing is described which depends upon these types of targets.

2. Other ball spin approaches are patented with specific marking patterns, which are different from the one we are currently using.

3. The acquisition setup is specific and different from what we are using. The approaches have differences in the geometry of the setup and acquired images and the timing and synchronization of the acquisition.

4. The approaches described all seem to presume the ability to get extremely high resolution, low noise data. Most of the approaches assume that with 2 "fixes" on the ball the spin can be computed. This is true, but with noisy data any single "fix" on the ball may lead to large errors. To solve this with better hardware can be quite expensive.

5. Most approaches seem to assume the ability to capture the data at high resolution and with a known and appropriate timing relationship. This can be done, but the cost of the resulting system may be extremely high.

U.S. Pat. No. 7,170,592 discloses a method for inspecting a curved object, such as a golf ball, including acquiring an image of a curved object using a detector, adjusting the image to minimize distortion and comparing the adjusted image to a predetermined adjusted master image. The novelty is in not requiring orientation of the object and the minimization of curvature distortion during measurement.

U.S. Pat. No. 7,143,639 discloses an improved portable, battery operated (power cell) Launch Monitor. The portable Launch Monitor includes a camera system, preferably four cameras, and at least two light systems for illuminating a field of view. The system includes data storage means and a display device. The system includes stored image references and recognizes images such as type of golf club and golf ball used during the measuring process. The system measures: club head speed, club head path angle, club head attack angle, club head loft, club head droop, club head face angle, club head face spin, club head droop spin, club head loft spin, and ball impact location on the golf club face, determines golf ball kinematic information such as ball speed, ball elevation angle, ball azimuth angle, ball back spin, ball rifle spin, ball side spin, and ball impact location on the golf club face. A video interface is provided to view and interface the resulting images and integrated analysis. The system may be network compatible to transfer data to a central server to display a golfer's characteristics, such as club characteristics, ball characteristics, ball trajectory, and equipment comparison. In other embodiments the network may be capable of transmitting transaction information, such as an equipment order, financial information of a purchaser, a shipping address, and salesperson information, to a central server. Additionally, the network may be capable of transmitting order confirmation information, updating software for the operating system, or transferring data to multiple data consumers.

U.S. Pat. App. No. 20070060410 discloses a method and apparatus for measuring golf ball launch conditions. This application has the same inventor as U.S. Pat. No. 7,143,639. The method includes acquiring an image of a field of view without a golf ball present and acquiring at least two images of a golf ball in motion within the field of view. The images are preferably based on one or more substantially circular markers that are included on the surface of the golf ball. After the images of the golf ball have been acquired, the image of the field of view is subtracted from each of the at least two images of the golf ball in motion. The location of a circular perimeter of the golf ball for each of the at least two images after the image of the field of view is subtracted may then be determined. The method also includes analyzing the circular perimeter in each of the at least two images to determine a position of the center of the golf ball in each image. The kinematic characteristics of the golf ball based on the substantially circular markers and the center of the golf ball in each of the at least two images may then be determined. A processor comprising a memory and software loaded thereon may be used to perform the subtracting and determining. Based on these steps, the kinematic characteristics of a golf ball such as side spin, back spin, trajectory, velocity, launch angle, and side angle may be calculated. An apparatus for determining the kinematics of a golf ball includes an illumination device selectively positioned to illuminate a field of view with light within a predetermined wavelength range, a golf ball having a surface that absorbs light within the predetermined wavelength range, and a background surface that reflects the light within the predetermined wavelength range. The background surface may comprise a high grey level surface in some embodiments. It may be desirable for the apparatus to also include a camera positioned to acquire one or more images of a field of view and a processor comprising memory and analyzing software loaded thereon. The software is preferably capable of analyzing the one or more acquired images to determine the position of the center of a golf ball.

U.S. Pat. App. No. 20070049393 discloses a method for predicting ball launch conditions. This application has the same inventor as U.S. Pat. No. 7,143,639 and U.S. Pat. App. No. 20070060410. The invention comprises a method for predicting a golfer's ball striking performance. The method includes determining a plurality of pre-impact swing properties for a golfer based on the golfer's swing with a golf club. The plurality of pre-impact swing properties may include, for example, an impact location, an orientation of a golf club head, and the golf club head speed. The slippage between the golf club and the golf ball is preferably determined. The slippage may be based on the plurality of ball properties, the plurality of club properties, and the plurality of pre-impact swing properties. The slippage may be determined by computing each time step, in microsecond time intervals, for a first slip period, a stick period, and a second slip period between the golf club and the golf ball. It is desired that each time step is based on at least a transverse force of the golf ball, a coefficient of friction of the golf ball, and a normal force of a golf ball. The pre-impact swing properties may be determined by having a golfer swing a golf club in front of a monitoring system. The golfer may swing the club any desired number of times in order to generate accurate pre-impact swing properties. The pre-impact swing properties are preferably based on about 1 or more swings of a golf club.

The golf ball properties that are determined include, but are not limited to, the coefficient of restitution of the ball at a plurality of velocities, the time of contact at a plurality of velocities, and the spin at a plurality of velocities and loft angles.

Additionally, the golf club properties that may be determined include the geometric center of the club face, the center of mass of the club head, the distance from the hosel to the center of mass of the club face and/or the center of mass of the club head, effective density of shaft material, the effective shear modulus for torsion about the shaft axis, the effective Young's modulus for the shaft material, and the outer and inner diameters of the shaft in two directions at the hosel end.

Thus, a golfer is only required to swing a golf club once to determine a predicted trajectory of the golf ball and the ball launch conditions. The predicted trajectory may include characteristics such as distance, flight path, landing position, final resting position, and the like. Moreover, the ball launch conditions may include the side spin, back spin, rifle spin, azimuth angle, launch angle, velocity, and the like.

The method described above may be performed using a computer program comprising computer instructions.

U.S. Pat. Nos. 6,241,622 and 6,488,591 are related patents disclosing a portable launch monitoring system that includes two cameras, strobe lights, beam splitters, reflective elements and reflective golf balls for recording images and determining the ball flight path in a pre-determined field-of-view.

U.S. Pat. Nos. 4,375,887 and 4,063,259 are related patents disclosing a launch monitoring system for measuring initial velocity, initial spin velocity, and launch angle to match a golfer's swing to a preferred golf ball having characteristics that best exploit the swing.

U.S. Pat. No. 4,160,942 discloses and optical object project used to display a simulation of a projected objected measured by a trajectory calculator including multiple cameras and data analysis.

U.S. Pat. Nos. 4,158,853 and 4,136,387 disclose a method for monitoring the flight of a golf ball (or any sports ball) post-launch preferably including multiple cameras and corresponding flash lamps triggered for measuring position, velocity and spin of a golf ball.

U.S. Pat. App. No. 20070032143 discloses a real time visual self-monitoring system including a camera and a monitor preferably mounted on the user's head.

U.S. Pat. App. Nos. 20070026975 and 20070026974 are by the same inventor and disclose a trajectory detection and feedback system using one or more cameras, an infrared emitter to illuminate a tracked object, and a data analysis for analyzing the recorded sequence of video to determine proper technique.

U.S. Pat. App. No. 20070010342 discloses a virtual model of a golf ball for simulating a trajectory and modeling a golf ball based on the virtual data.

U.S. Pat. App. No. 20040142772 discloses a measuring apparatus where the photographing is carried out from the back part by means of the first camera and the second camera and is carried out from the front part by means of the third camera. The position coordinates of the ball are calculated by a triangulation method based on image data obtained by the photographing from the back part and image data obtained by the photographing from the front part. The photographing to be carried out from the back part is relayed from the first camera to the second camera. The angle of view of the second camera is related to that of the first camera. Therefore, the ball can be photographed within a wide range of the trajectory through the relay.

The first camera should be positioned behind a ball launch point, the second camera should be positioned between the launch point and a drop point, and the third camera should be positioned before the drop point. Since the second camera is positioned between the launch point and the drop point, an angle formed by an optical axis in a horizontal direction can be set to be great. The angle of elevation of the golf ball measured immediately before the drop by means of the second camera is great. The measuring apparatus has high precision in the measurement of the ball immediately before the drop.

The angle of view of the first camera should partially overlap with that of the second camera. The angle of view of the second camera is related to that of the first camera based on ball images which are simultaneously photographed by the first camera and the second camera.

Other prior art refers to the use of a GPS system for measuring and displaying data:

U.S. Pat. No. 7,175,177 discloses a golf data management system including a PDA having a GPS and a processing unit that, among other things, provides individual player analysis based on data input by the player and data derived from a measuring unit based on the golf club used and the shot distance.

U.S. Pat. No. 7,118,498 discloses a portable GPS system for measuring and displaying distances between a golfer and an object, such as a target, based on golf course geographic information services. The system also provides a means for measuring data, such as wind direction and magnitude, along with elapsed time of play.

U.S. Pat. No. 7,095,312 discloses a portable GPS system for measuring and displaying attributes of a sports object, such as a golf ball, using an embedded electronic tracking device associated with each sport object.

U.S. Pat. No. 7,010,550 discloses a PDA for inputting, recording, and storing a player's hole-level and shot-level information. Data input may be off-line or on-line internet interactive.

U.S. Pat. No. 6,697,820 is a variation of U.S. Pat. No. 7,010,550 by the same inventor.

U.S. Pat. No. 6,585,609 discloses a scoring booklet related to a particular golf course. Each hole illustration is comprised of a grid corresponding to an interactive internet grid. The player indicates the golf ball location for each shot on the hole grid and then downloads the information to the interactive internet grid for historical data exchange based on previous golf rounds on the same course.

Still further, other prior art systems include:

Blackwell Synergy discloses a study measuring the movement path and speed of the clubhead as well as the clubface orientation and impact location during golf swing using 3D analysis video techniques.

IMAGO Video Trackers discloses a system for measuring the true trajectory of a golf ball by tracking the ball from launch to landing. This differs from previous systems that interpolate the ball flight by measuring the initial and landing ball positions.

NASAexplores discloses the use of high speed video equipment to capture a golf ball in flight. Computer hardware and software is used to analyze the measured spin rate and velocity of each ball resulting in a better designed golf ball.

Pitt Research discloses using advanced biomechanical assessment tools to measure rotation and velocity of the upper torso, pelvis and x-factor during a golf swing. Other measurements such as ball velocity and the relationship between biomechanical variables were assessed using a high speed eight camera 3D optical motion analysis system.

Sports Coach Systems discloses a simulator mat having an enclosed circuit board and including infrared technology to measure both the club and ball through the impact area.

Zelocity discloses a golf performance monitor that uses Doppler radar to measure the ball's velocity, spin and launch angle. Club head speed is also measured in the down swing and at impact.

SUMMARY OF THE INVENTION

The present invention overcomes the disadvantages of these prior art methods, systems and apparatuses by providing higher precision with lower cost for a more successful analysis.

The invention is a system that collects and analyzes golf related data. Preferably the data analyzed is related to golf ball analysis: ball trajectory, including launch angle, ball velocity and ball spin; swing monitor; launch monitor; putting profiler; ball finder; and automated performance enhancement. In a preferred embodiment, at least one camera is used to record images of ball flight. Multiple cameras or a high speed camera may also be used in conjunction with a strobe light or infrared illumination. Some examples of data tracking and analysis are:

Ball Spin Analysis—tracking the movement of a marked ball with a calibrated camera. The ball marks must have a predetermined relationship and the images of the ball in flight must have a known time relationship. Curve based marking may be used and the data may be mapped into 3-D surface coordinates. Tracking an unmarked ball is also possible when several images with a known relationship are recorded in the same region for comparative analysis.

Club Analysis—uses two cameras to acquire the 3D edges of a golf club. Orientation of the club face and the starting point of the golf ball along with trajectory are recorded. The instant of hitting is determined from the trajectory, providing the calculation point at which the club strikes the ball and the orientation of the club face at the point of strike. Specular reflection from the club face is a preferred form of measuring the necessary data. Visible or Infrared light may be used and the cameras may record a silhouette or straight on illumination of the club face features to determine a 6-axis trajectory.

Swing Analysis—of a golfer uses multiple cameras and the silhouette to record data that is compared to model swings. A silhouette is generated from the model with minimal deviation from the captured golfer silhouette. A model of the golfer's swing is created and matched to the swing under study.

Putter profile—may also be analyzed by capturing position of the club, golfer and ball through the entire putting sequence.

The invention may also be used for Vision based training systems and automated enhancement performance in sports and medicine. Specifically, a golfer's motion profile, swing set profile and skeletal motion may be analyzed and improved.

DESCRIPTION OF THE DRAWINGS

The above, as well as other advantages of the present invention will become readily apparent to those skilled in the art from the following detailed description of a preferred embodiment when considered in the light of the accompanying drawings in which.

DESCRIPTION OF THE PREFERRED EMBODIMENTS

Figure 1:
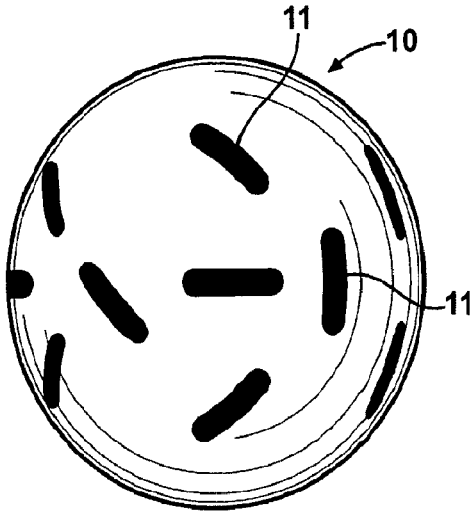
FIGS. 1-4 illustrate a dash or line segment marking on a ball for spin determination according to the present invention.
Figure 3:
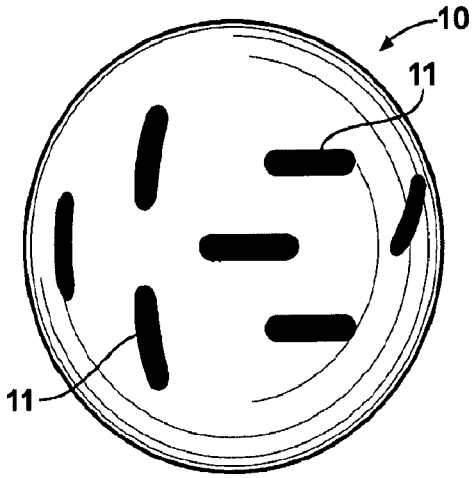
Figure 2:
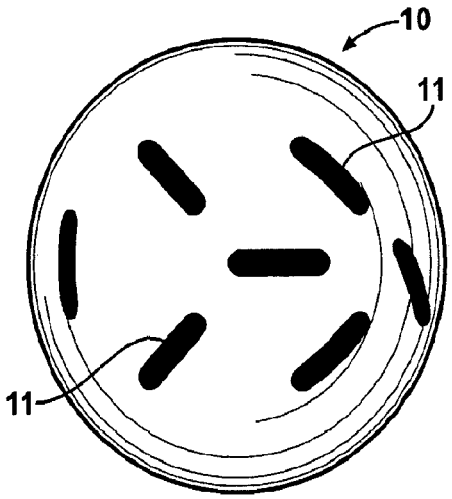
Figure 4:
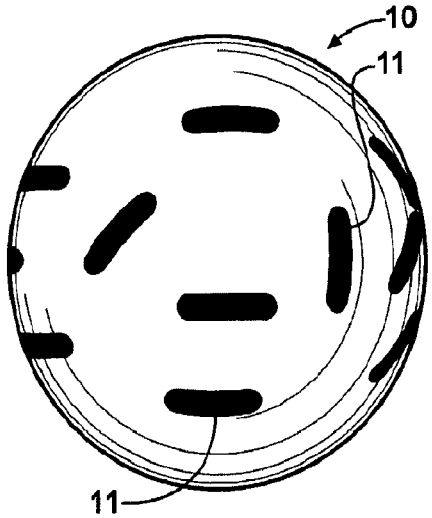

In the first of several preferred embodiments, the present invention provides a marked ball launcher as set forth below. The term "ball" is used herein to represent any object of interest that moves and for which location and movement data are generated by the system and method according to the present invention.

MARKED BALL LAUNCH MONITOR—System Description—A launch monitor is a system for finding the launch data for a ball. This consists of: ball initial position; ball initial 3-D trajectory; and ball spin axis and spin rate.

Setup—The system consists of: a set of cameras which create images of the potential flight path of the ball, all camera devices are on a common time base; 3-D calibration data for the cameras; a processor which creates final results; and optionally an illumination device with associated timing information. All devices are connected and able to share information.

Image Acquisition—The system creates a series of images which are time stamped, along with the timing of any illumination device.

Image Analysis—The series of images is analyzed to determine if a ball is in the camera view. The illumination device, if the ball is in motion, can cause multiple images of the ball. The analysis of the images proceeds as follows:

Are there any balls in the image?

What is their center and diameter in image coordinates?

Are there internal features or marks in the ball images, if so what are the pixel coordinates?

Is there strobed illumination? If so are there multiple images and how do they correspond to the strobe timing?

Once observations are found which correspond to ball motion, then the future motion of the ball can be predicted. The next images can be estimated in image space, or mapped into 3-D and predicted with a flight model and camera 3-D calibration data. This prediction can then be used to reduce the number of pixels processed, and also allows ignoring areas of the image which may contain contradictory data. If the prediction is wrong, then the flight of the ball is not consistent with ball flight models and so further analysis is unnecessary.

Image Observations—The result of the image analysis step is to create a series of distinct observations of the flight of the ball. An observation is:

Camera used.

A ball center position in image space.

A time stamp for the ball center position.

A set of features which have been extracted from the image of the ball.

A set of pixels of the object image.

3-D Observations—The set of observations are analyzed to determine whether a ball has moved and if it has moved consistent with a flight model. The set of observations is transformed into 3-D positions and the 3-D positions and time stamps are checked for consistency. If it is a valid ball flight, then the sets of features are analyzed and used to determine the ball rotation offset. This step may also locate areas which should have ball image information, but which for some reason require special processing to extract.

Spin Computation—The observations are then used to compute the initial launch position, launch trajectory and the spin axis and spin rate. Observation Criteria are:

- Minimum time between observations such that max rotation<PI.
- Distinct time intervals such that aliasing does not remove rotation information.
- At least two observations so Field of view size>max_vel*acq_time*3.
- Can only get internal features near center of object.

Image Acquisition Approach (2 or more Medium speed cameras—continuous light)

Acquisition Approach—Offset in time 60%-40% to get shortest interval of 2 ms, and 2 intervals for computation of spin from bias between shots of different timing. Time stamp observations—which allow use of all observations to remove ambiguity introduced by inaccuracy or rapid spin past 180 degrees. Lighting via constant light, sunlight or a strobe fired by the camera for each acquisition.

3-D Observations and Trajectory—Still need 3-D position of balls for accurate 3-D position of balls which allows computation of spin and velocity and 3-D trajectory. To find 3-D position of balls with only 3 shots, 2 from one camera, 1 from the other, do the following: Use the time relationship between the 2 images from the $1^{st}$ camera to the single shot to find the 3D slope of the line the shots must be on. To find 3-D position of balls with 2 images from each camera find the 3-D plane through each camera center for each cameras ball centers in image coordinates. Then intersect the two planes to find the 3-D line the ball has made. Note that with more points a curve can be fit to the points, and the 3-D best-fit curve computed. Now intersect each ball image center with the found 3-D ball trajectory to find the ball center in world coordinates. The 3-D ball trajectory can be intersected with the ball placement plane to allow the computation of the ball origin. The Velocity is found by the maximum of the pair-wise computation of the velocities between all pairs of observations. The net result is shots with correct timing relationship.

Multiple Cameras—The number of cameras can be increased to cover larger areas, and as long as the cameras timing relationships are known, and calibrated to a common coordinate 3-D system.

Strobe light—2 or more slow cameras—With a strobe light with a controllable firing pattern of up to 1000 Hz the data to allow the capture of the launch data from all possible golf shots is possible by using only 2 slow (60 fps or less) cameras. The range of shots capturable is 100 m/s to 10 m/s with less than 18,000 rpm of spin. A second range of shots from 50 m/s to 5 m/s is possible. Below 5 m/s, the spin has only a small effect on the ball flight. The problem with using a strobe without knowing the shot velocity in advance is the desire to capture distinct shots. At a slow enough speed the images overlap each other. At a fast enough speed there are not any images. The relationship of the camera acquisition rate and exposure, and the strobe timing determine the number of distinct observations possible. This interacts with the range of velocities and spin rates which are possible. The goal is at least 3 distinct observations with correct timing relationship.

Image Acquisition—The two cameras are synced to the strobe such that a specific strobe pattern is fired upon start of frame of each camera. The cameras can be synced to start at the same time, or not, it only being required that the time offset of the respective start of frame be known. A strobe pattern is selected which always results in at least 3 distinct observations given the interaction of the setup with the range of shots possible.

Image Analysis—The first step in the image analysis is to find the distinct images. This is done by blob analysis which checks for a connected component of the correct area and eccentricity. These become candidates that are then processed both for consistency and internal features. Further analysis can be done on partially overlapping images with the portions of the curve available used to determine the non-overlapping area. The minimum circle can then be fit to each circle, with the interior now divided into distinct areas and overlapping areas. The resulting center and area now defines a candidate. Distinct areas can now be processed for marks. This is also true for images of the ball at the edges of the image. Similar processing may produce additional observations. The 3-D Observations and Trajectory can proceed with the resulting Image Observations.

Example—For a min speed of 10 mm/msec. By firing a strobe 1 ms after the start of frame and not firing another strobe until at least 4 ms has passed. And waiting at least 4 ms before firing a strobe 1 ms before the end of frame: 2 distinct images are obtained (the end of previous frame, $1^{st}$ in current frame) which have a time offset of 2 ms. One of these pairs is acquired every 16 ms at 60 fps. The basic pattern for a 16 ms interval (1 ms resolution) is: 1000 0110 0110 0001. Note that each 7 ms subset contains at least 2 images. Each 17 ms subset contains at least one pair of 1 ms interval images acquired over 2 frames with at least a 4 ms gap. If the velocity of a shot is slow enough for its images to merge with the next or previous then the shot is discarded. The value of the special shots is two shots which have a short time relationship, but are guaranteed not to merge. We need at least 2 observations from each camera, preferably 3 or more.

Programmable Image Acquisition to Capture Observations—A set of image acquisition operations which adapt to an object in flight, allowing the capture of the necessary number of observations with usable timing relationships. For many cameras the rate of image capture is proportional to the number of lines captured. In addition the same area can be covered, but the number of lines reduced by using hardware binning or other techniques. With binning the area covered remains the same but the number of lines is reduced by a multiple of 2, but the resolution is also reduced by the same multiple. The capture rate is increased by the same multiple. Some cameras allow the changing of the acquisition parameters while acquiring, typically the change taking effect with some delay. The object always has a limited range of possible speeds. Typically a high speed object would pass through the field of view of the camera within a single frame time. So two acquisitions at the full frame rate are not guaranteed to capture two pictures of the object.

For object acquisition using a camera with the ability to achieve a high frame rate while capturing less lines and at a reduced resolution the following steps can be used to acquire full resolution object images:

- Initial area acquired is with binning on, and only enough lines to be certain to see the ball at its maximum speed.
- The pixels from the initial lines are checked for the presence of an object by checking the pixel values for a change from the initial values. The histogram of the initial lines could also be examined for changes to detect the object initially.
- When an object is found, the acquisition parameters are set for the soonest acquisition possible which will capture the object moving at the maximum speed. The size and placement of the $1^{st}$ full resolution capture will be related to where in the initial area the object is found, the maximum speed possible.

A second acquisition is done of the initial area. The change in the object position between the $1^{st}$ and $2^{nd}$ initial acquisitions is used to estimate the direction and speed of the ball across the image.

This information is then used to predict the objects position across the sensor. A set of acquisitions which restrict the acquired lines to those which will capture the object is found. The object size is used to determine the number of lines to acquire, with several extra lines to allow for errors in the determination. Note that at this point the next acquisition may already be set up.

The object's size, velocity and position will be used along with the line timing to determine the start and number of lines to be acquired until the object is no longer in view.

In the case of a high speed object, this may entail just one more acquisition at full resolution—of the rest of the image sensor.

The amount of time the object is in the sensor view is found from the initial two estimates which yield its velocity.

For slower objects there will be time to capture numerous shots. The position of the object would be computed, with the next acquisition area updated taking this position into account.

Images of features on spinning object—Using the above approach the path of the ball across the image sensor is predicted, and the object tracked, using a reduced number of lines to capture the object at a higher rate than using entire frames. The speed up is approximately the ratio of entire image frame rate divided by the number of lines which the object occupies. If we now process the high speed images as we track the ball position and extract a feature of interest to us in two successive frames, or we extract 2 oriented features with a known 3-D relationship, or 3 features with a known 3-D relationship, we can estimate the spin rate of the object. The spin rate and axis is approximately constant for an object in free flight so that we can now predict where and when more features will be located in the view of the images sensor, and how to position a window to capture them. We capture a selection of high resolution images of the features of the ball and timestamp them.

The matching up of features to a 3-D model of the features can be accomplished by making a projection of the features of the model subject to the time intervals which have passed between images. Using a feature in the $1^{st}$ image make a rotation of the model to match its position as seen in the image—relative to the object center. Now a $2^{nd}$ and $3^{rd}$ positions are taken from the image. For each possible feature rotate and project the model to match the found positions. Try all combinations and use the one with the smallest image error.

Find a set of time stamped features with position relative to object center of mass.

Take the $1^{st}$ feature and rotate the 3-D model and project to match its image position.

Take the $2^{nd}$ feature and rotate the 3-D model and project each model feature in turn to match the image position. This will create n rotations.

Take all additional features and rotate the 3-D model and project each model feature in turn to match the image position. This will create n rotations for each additional feature.

Divide each rotation by the timestamp to get a rotation rate implied by each feature choice.

Select the feature to 3-D model labeling which minimizes the deviation from a constant rotation rate.

The positions of the feature can be chosen to provide the least ambiguity by irregular, wide spacing.

With the set of labeled features create time stamped 3-D positions relative to each other find a best-fit spin axis.

We can also acquire images of the entire object at various points along its path by changing our acquisition parameters, so that we have several positions of the object center of mass at sufficient resolution to fit the object position to a curve and infer the object center position for any time stamped feature observations. An additional approach to do this is to use the object center observations from multiple calibrated cameras to create time stamped 3-D positions. These can then be used with an object flight model to create a flight 3-D trajectory. The time stamped feature observations can now be supplied with 3-D positions by using this 3-D trajectory.

Current Launch Monitor System—Camera Setup—Cameras are mounted above tee, partially overlapping fields of view. Note that the cameras can be mounted in any positions with overlapping fields of view. The camera positions will affect the accuracy in each dimension and also the ease of installation and protection from being bumped. Our cameras are calibrated, so we wish for them to be bumped as little as possible. The lights are overhead, located outside of the cameras, and between the cameras. Cameras are calibrated with planar calibration target. The timing of the exposures for each camera is known for each processing iteration. It is not necessarily fixed.

There are two approaches: Using high-speed cameras with one ball image per frame and having multiple exposures per frame. This can be done with a strobe system or with a camera, which allows multiple exposures per frame. In the following, the image search needs to know whether it is looking for 1 ball or multiple exposures. The processing is the same other than the image search identifies candidate balls and they are paired with timing information and when their validity is determined included to create a candidate observation. Note that the inputs to the system are not controlled with many possible causes for "false" triggers.

Image Search—The system searches through each image once it is armed looking for a golf ball image. If found the $1^{st}$ step of processing is done to verify that a valid golf ball has been acquired. Images are stored as necessary so that no images are lost. If a ball is stationary in the image its position is found and it is ignored by the system. This creates a blind spot for the system. A mask is created of ignored regions of the image for the purpose of finding an initial image. In addition a ball once starting in the FOV, will be ignored as it moves out of the camera's view.

Find ball 3-D camera features—Each image is searched for positions with potential golf ball images. If a candidate is found, each camera extracts the ball blob, with a minimum enclosing circle algorithm, corrected by adjustment for position. A measure of the quality of fit for each circle is computed. The best quality circle is used for the ball from that image. Each camera line in image space is found, this line is taken to a 3-D plane in world coordinates. The travel of the ball across the images is tracked and when the ball is across the image, no further images are processed. If at the beginning of the process no further images of the ball appear, then this is considered a false start, and the images are flushed and the search for a start continued.

Find 3-D Trajectory Line—The two lines are intersected if both exist to find the 3-D trajectory line. Errors from line are found and outliers are removed if possible. If only one point from one camera and one line from the other camera a separate algorithm is used to find the 3-D trajectory line. A measure of the fit of the ball images to the line is computed.

Extract Stripe Information—The image of the ball is extracted using the ball position and diameter. The image is normalized and the dark stripes extracted.

Connect—The stripe information is connected into stripes by comparing the distance squared between any pair of adjacent points to a pre-computed valued based on how far the points are from the center of the blob.

Thin—The connected stripes are thinned in the following manner:

They are assumed to lie on surface of sphere.

Only one hemisphere is visible.

They are ordered about center of sphere, theta runs from one end to the other.

For delta degrees and find weighted center of mass and produce a single point.

Label and Find Rotation—The thinned stripes are labeled and matched to the model to find the six-axis 3D offset of the ball from a nominal position for all captured ball images.

An initial estimate is made using the ordering of the rings.

For each possible combination create candidate labeling.

Plane fit rings with side constraints,

Find error for each candidate labeling.

Use best-fit labeling.

Project into 3D using estimate of ball center, diameter and 3D rays from camera.

Assign weights to rings based on quality of fit.

Find 3D rotation matrix by using two strongest normals of rings found.

Recombine unused points and repeat fitting if necessary.

Use distance of movement of plane to estimate center error.

Recompute using revised center error if necessary.

The found 3-D position is used for the offset position. The 3-D rotation is computed and added to 4×4 offset matrix TRAJECTORY SPIN SYSTEM—System Description—Unmarked ball—deflection method—Flight Model: With an unmarked golf ball use is made of a valid ball flight model which for a given initial velocity, initial launch angle, ball Reynolds number function (temperature, humidity, wind speed), ball mass can compute the ball trajectory given the ball spin.

Find Initial Curve—A sensor obtains an initial segment of the ball trajectory. Typically with a sequence of measurements which allow the determination of the best-fit trajectory quadratic function. (For example, in the initial 1 m of ball flight 10 measurements of position are made). The initial velocity and launch vector are determined.

Project Flight—The found velocity and launch vector which best fits the trajectory of the ball is used in the ball flight model to project the flight of the ball through a second segment of the ball flight. (For example from 2 m to 3 m a 1 m distance).

Compute Spin Table—This flight model is used to find a series of trajectories with various spin rates and spin axes.

Find $2^{nd}$ Curve—A second sensor captures a series of positions which determine the trajectory in the second segment of the arc. (For example, 10 measurements of 3-D position from 2 m-3 m). These positions are fit to a best curve, which includes the initial segments positions.

Fit Curves—The ball flight model curves which fit the initial curve and which represent the various spin values are compared to the $2^{nd}$ curve. The "spin curve" which minimizes the area between the two curves is found. Alternately the maximum deviation of the $2^{nd}$ curve from the 0 spin ball flight model at a given time can be found, this indicates the spin rate and is the effect of the magnus force.

Determine Spin—The direction of the maximum deviation indicates the movement of the spin axis away from pointing to the right. This indicates the direction the magnus force has acted in. This approach requires data over a large enough area so that the effect of the magnus force is measurable with the accuracy of the measurement system. The images can be a single cameras view of the trajectory or two or more cameras views over multiple segments of the trajectory. Some of the shots with different spin values may have similar curves. In this event other information about the shot is used to choose the best value. There will be club data, logo spin data and the likely shot type, all of which can be used to select the most likely solution. The ball flight model must be able to determine the trajectories accurately enough given the measurement system. Typically the model parameters would be determined experimentally from multiple representative shots which are interpolated to allow coverage of all shot types. This data may need to be acquired for each ball type used which will have slightly different parameters.

Acquisition Approaches—In addition to finding distinct ball images by illuminating the white ball using the above standard techniques, other approaches can be used. In finding the trajectory curves overlapping images can be processed to find the trajectory they describe.

Smear Approach—The field of view of a camera is lit with constant illumination, which exposes the image continuously. The resulting smears then represent the flight of the ball and the movements of the markings on the ball represent the spin axis and rate. A strobe needs to be fired at a constant rate to produce bright timing marks in the image to allow accurate timing information. Alternately a strobe light can be used which is normally on, with short intervals of Off which allow timing to be computed. The marks on the ball now have the requirement that they produce a distinctive pattern as they smear with the rotation of the ball. An algorithm to determine the spin from the smear pattern is of several types:

Build table from artificial images of known spin and use pattern matching and interpolate.

Look for periodic patterns with various search lines.

Similarly the club movement can be captured as a smear, either in positive form or as a silhouette of the club. Depending on the 3-D relationship between the club face and the cameras, the edges in several cameras in the silhouette can describe the 3D movement of the club face. A setup will be needed which works for the range of clubs used, and allows the cameras unobstructed views of the club. This approach is ideal since it directly produces a curve to fit. The smears can be extracted from the image by blob analysis, edge following or other standard techniques.

Silhouette Approach—If a screen is stretched across the front, side or back of the tee area and illuminated in visible or IR, the passage of the ball or club can be measured by processing the silhouette of the ball. The silhouette can be from an exposure short enough to freeze the motion of the objects, or if longer create a smear. The silhouette can be extracted from the image by blob analysis, edge following or other standard technique.

Shadow Approach—The object can also create a shadow on the background, if the camera and illumination source have the correct relationship. If the light position, direction and attributes are found, the shadow can be used to find the 3-D position of the object. The shadow can be from an exposure short enough to freeze the motion of the objects, or if longer create a smear. The shadow can be extracted from the image by blob analysis, edge following or other standard technique.

DIMPLE SPIN SYSTEM—An approach which is a setup and processing approach to find the spin on an unmarked ball using images of the ball is described in Kiraly, US 2004/0032970 A1. We are not convinced that this approach will work on anything but a "marked up" unmarked ball. The patent application does not address the limitations of this approach but we think they are significant and would not result in a product which had enough precision and reliability to be a viable launch monitor product. The Kiraly Basic Method is:

Calibrate single camera at factory.

Compensate for direction camera pointing.

Find 3D position of ball using image ball diameter and known diameter.

Image mapped to 3D removing glints.

Rotate Ball and recreate image.

Find centers of dimples.

Then find 2D correlation of dimple centers of that image against previous image.

Iterate to find least error.

It assumes that image is going to look similar, only transformed by ball rotation. Appearance of dimples depends on 3-D position of ball. This might be true if rotation is small enough. Glints are in center of ball. Removal of glints, removes important information from center of ball. This could have a dramatic effect on accuracy of measurement.

In contrast Applicant's approach is:

Calibrate pair of cameras in 3D.

Find 3-D launch data for ball.

Pick out pieces of image (dimples) for 1 or more cameras.

Rotate Ball given amount.

Re-create image of ball from sub-images (of individual dimples or marks).

Model effects of change in lighting angle on dimples.

Do correlation on resulting recreated images or on individual sub-images.

Locate dimple, replace with "bumps", for both images. Then correlate in some space (possibly 2D/panoramic projection).

Note that we are not correlating the centers of the dimples, but subimages of the ball. May use multiple cams in time or with RGB or IR filters, stagger acquisition in time, and use glint pattern change in time to determine rotation. Algorithms include correlate sub-pictures and then abstract for large correlation and—non-iterative—each iteration by rotation of ball, we may take recreated image and move in 2D and then calculate result in 3D.

Figure 5:
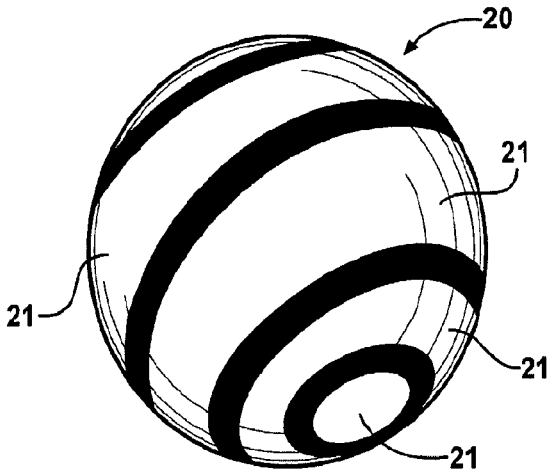
FIGS. 5-6 illustrate a ring marking on a ball for spin determination according to the present invention.
Figure 7:
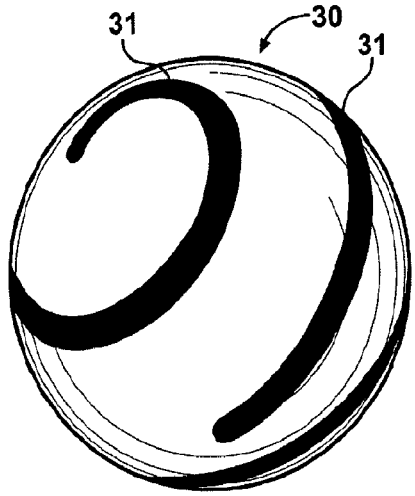
FIGS. 7-8 illustrate a spiral marking on a ball for spin determination according to the present invention.
Figure 6:
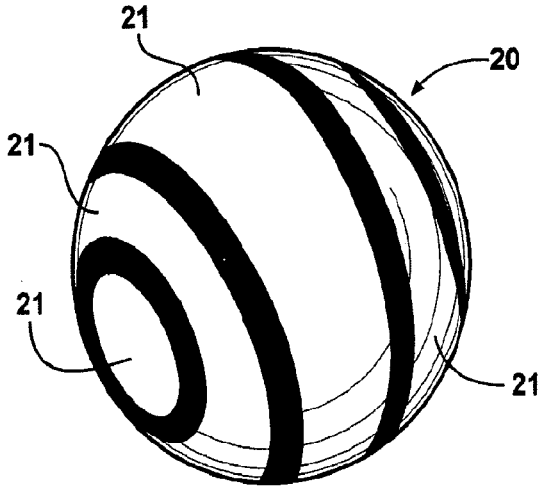
Figure 8:
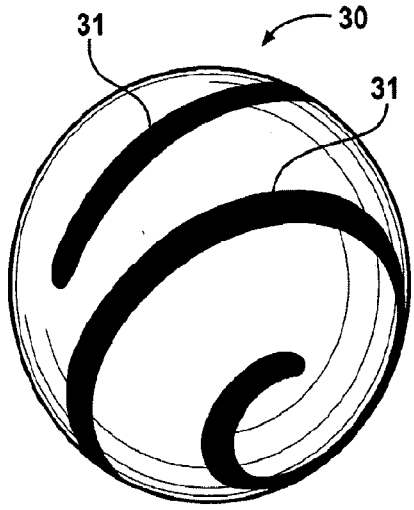

BALL MARKING FOR SPIN DETERMINATION—Marking approaches—The present invention provides a marking system which allows orientation from any view and allows labeling from any view:

Line segment approach—see FIGS. 1-4.

circle approach—See FIGS. 5-6.

arc approach—distance of any 3 arcs unique—normal of any 3 arcs unique—See FIGS. 7-8.

Ball Designs for Spin Determination—The marked ball spin measurement approach which we are taking seems to be novel. Every approach I have seen seems to rely on a set of target points on the ball, usually only in one region of the ball. All of our designs so far have as their goal that there is some processing approach that from any single image of the ball the 3-D orientation of the ball can be discovered. There are many designs which have this attribute. The ball designs allow the ball to be teed up in any position, and the images of the ball to be captured at any time or position along its path. It allows the identification of which view of the ball is being seen, and then the computation of the spin at that point. These two steps are essential to allowing the ball to be in any position, and to find the spin with any two images. Further images and careful timing of the acquired images may be necessary to reduce the indeterminate interval and to increase the accuracy of the measurement.

With reference to FIGS. 1-4, one family of ball designs would have dot patterns placed on specific areas of the ball 10 with the visible area of the ball always containing a unique pattern. The marks could be dots, rings, line segments 11, arrows or any directed or undirected mark. Directed marks are preferred since with less of them the uniqueness of the pattern can be used to find the orientation of the ball. This approach really amounts to mapping 2-D barcode technology onto the surface of a ball.

With reference to FIGS. 5-6, another family of ball designs uses lines on the ball 20 which have a specific geometric relation to each other. A circle pattern with non-aligned circles 21, each circle has a unique center and normal.

With reference to FIGS. 7-8, the ball 30 has a spiral design 31 that is described below.

Many other patterns are possible which have the same attributes. In addition the above patterns can be used with breaks in the line. This allows the ball to be marked in an easier fashion, but complicates the processing. In this approach "lines" of a certain width can be used, with the center, or two edges of the line being determined. A second approach is to have contrasting regions of dark/light or colors with the edges between the region defining the shapes. The edges are then extracted from the image.

5 Circle Design FIGS. 5-6—This design has five circular marks, with different diameters and normals. The normals all point in different directions and the diameters are all different by as much as possible. The mark has some width, which is smaller than the minimum distance between adjacent circles. The circles are arranged from top to bottom. This pattern as used has no breaks in any of the circles. The design could be modified to allow breaks in the circles. The processing to recover the circle is detailed above in the Marked Ball Launch Monitor section.

Spiral Design FIGS. 7-8—Two spirals, one clockwise from top to equator, the second counter-clockwise from bottom to equator. There are 1.5-2 turns between the pole and equator. The processing to recover the spiral is similar to that for the circle. It requires an algorithm which given an extracted 3-D segment, determines where on the spiral the segment is from.

Multi-Arc Design FIGS. 1-4—Short arc (6 mm long and 3 mm wide, for instance) are distributed seemingly randomly about the surface of the ball according to the following constraints:

An area around the circumference is left unmarked to facilitate printing.

An area is left near one pole with 4 unmarked areas which allow a marked "wet" ball to rest on a gripper.

The marks which are adjacent to each other have orientations as distinct as possible.

The marks which are adjacent to each other have center positions as distinct as possible.

The marks are as few as possible, while still having at least 3 visible in any view.

The marks obscure the perimeter of the ball as little as possible.

In a single view if some marks obscure the perimeter of the ball, the other marks in view on the opposite side of the perimeter have an orientation so that they do not.

Extraction Algorithms—The algorithm is identical until the labeling step. The labeling is done by using both the distance between marks and the orientation of the marks. They form a unique pattern and so the best labeling is computed by checking all possible labelings. Once the labeling is found the rotation of the observation is determined from the model for the design.

SPIN DETERMINATION FROM MULTIPLE OBSERVATIONS—An observation is an image of a ball which has a time stamp and the calibration data of the camera with which it is taken. It may consist of the resulting data extracted using the previous inputs such as a 6 axis offset representing the orientation of the ball, the ball's position, the positions or distribution of various sub images extracted from the ball along with confidence values created along with the extracted data.

Spin computation—The set of observations of the ball is used to compute the spin axis and rate. An observation is a 3D offset matrix with a camera and time stamp associated with it. A twist is defined as movement about a 3D axis of a certain amount. Find the apparent twist between each pairing of observations. This twist value is weighted by the sin/2 of the angle between the twist values. A weighted average of these twists gives a spin axis. The spin values are computed with overall confidence values, and the individual deviations from the computed spin axis and rate are found. These are then used to remove outlying values and the spin is recomputed. The resulting spin axis vectors and spin offsets are graphically shown in 3D to allow an operator to verify the values are correct. An animation of the flight of the ball with the spin axis indicated and its relation to the actual acquired data is shown. Images of the ball at any intermediate position are created to allow the viewing of the ball from any angle and at intermediate positions.

Rotation Axis and Rate calculations—The first three cases below assume that a means already exists to compute consistent 3d coordinates from marks observed on a spherical object.

Case 1: Marked ball with known model and 2 labeled observation sets. For two observations, the direct method is to calculate coordinate frames; $F_{c1}$, $F_{c2}$, based on the current set of fiducials (potentially including the ball center), and then using the same algorithm with the corresponding model fiducials calculate the model frames; $F_{m1}$, $F_{m2}$. Expressing the coordinate frames as matrices using homogeneous coordinates, we can calculate the offset matrices which will move the model to the observation positions by:

$$O_1=F_{c1}*F_{m1}^{-1},\ O_2=F_{c2}*F_{m2}^{-1}$$

The desired offset matrix R, which rotates $O_1$ into $O_2$ can be found by:

$$R*O_1=O_2,\ R=O_2*O_1^{-1}$$

$$R=F_{c2}*F_{m2}^{-1}*F_{m1}*F_{c1}^{-1}$$

If desired, the rotation matrix can be easily converted into equivalent angle and rotation axis formats using standard procedures.

Quaternion format; $(\cos(\Theta/2), \eta_x \sin(\Theta/2), \eta_y \sin(\Theta/2), \eta_z \sin(\Theta/2)$, or (angle, vector) format; $(\Theta, \eta_x, \eta_y, \eta_z)$.

Note that the angle is only known to a (+/−) N*2π interval. The rotation rate calculation is based on the known time difference between observations; $(T_{o2}-T_{o1})$, and must use assumed physical limitations on spin rate and direction to determine the proper interval N. Spin rate=$(\Theta+/-N*2\pi)/(T_{o2}-T_{o1})$ Case 2: Marked ball with known model and N labeled observation sets. Any pair of observations will yield an angle/vector estimate using the procedure outlined in case 1. The vector estimates do not depend on 2 π intervals and a weighted average of the estimates can be directly computed. The average rotation rate calculation will depend upon finding the individual 2 π intervals that are consistent across observations as well as the assumed physical constraints. An alternate approach to finding the "best fitting" angle/vector is to set the problem up as a nonlinear error minimization problem of 3 variables, and then use standard techniques to solve for the unknowns. Multiple time intervals reduce the ambiguity and allows a solution even with rotations between observations greater than PI.

Logo Spin—For a known ball with identical marks on opposite sides of the ball then the spin rate and axis can be limited to a distinct set of possibilities. Note that in addition to positive identification of the marks, the absence of marks can also be used to limit the possibilities. The result from this calculation is not always a single value, but rather as set of ranges which are possible. Often other information will be used to determine the best possibility.

Case 3: Marked ball with unknown model and N observation sets. This technique requires common markings on the ball to be visible across multiple observations. The rotation of the markings will be perpendicular to the ball's rotation axis and the mark's displacement can be used to calculate a rotation rate.

Logo Spin—For an unknown ball the set of observations can be used to try to build a description of the ball consistent with typical marking of a ball. The known golf ball marking systems would be checked for consistency with the found observations and a model created if possible. However, if multiple observations exist which capture a mark or marks visible, then this can be used directly as above to find the rotation axis and rate, without building a model of the ball.

Case 4: Marked ball with unknown model and 2 observation sets. If the mark orientation can be found, and it's in both observations then the orientation change can be computed directly as above. Otherwise nothing is known, other than a lower bound on the size of the rotation. This is the case for a typical ball with logo mark.

SPIN DECAY MEASUREMENT SYSTEM—Consisting of:

- Spin measurement system which can cover a measurement volume of space and time stamp all shots found.
- Launching device which launches the ball repeatably with a set spin, angle, velocity so that a significant number of balls pass through the measurement volume at the end of the shot.
- Spin measurement system which captures the initial spin and launch data.
- Portable spin measurement which can be placed in center of ball landing spot for a specific set of launch conditions.
- Data collection system to record all information and compute results.

The system works by launching multiple shots with a specified spin, angle, and velocity. The landing spot for the shots are noted. The portable system is centered on the landing zone and enough shots are done to allow enough measurements of the terminal spin to permit accurate determination of changes in spin during flight. For all shots with both initial and final measurements, the spin axis and rate is compared between the initial segment and final segment, with the difference computed. This process is repeated for various initial conditions with the consistency of results computed and fit to a flight model with spin decay Example—For a given setting of spin, launch angle and velocity the ball is struck 20 times. The landing positions and their distribution are noted. A position is found where the flight of at least 5 balls pass though the measurement zone and the portable spin measurement system is placed there. If 20 measurements at this setting are desired, then 80 shots are made. Initial spin data is captured for all shots and paired with any spin data captured from the terminal segment of the shot. This is done by matching the time stamps for all spin measurements.

CLUB MEASUREMENT SYSTEM—To capture club data over a range of club head speeds two cameras with a strobe which fires can be used. The two approaches which don't require markings on the club are illuminate the club face or capture the club silhouette. The club silhouette can be obtained with a high speed camera which acquires images of the club as it moves against a background. If IR is used certain materials which are strongly illuminated by IR light can be used. However the club moves in a predictable path toward the ball, so the region which must be acquired is much smaller than the entire image. Hence the acquisition region can be computed and the effective acquisition rate for a club could be 200 fps which is fast enough for at least 3 positions before and after. Note that some commercial sensors, such as come CMOS sensors, allow capture of Areas of Interest, whose speed of acquisition is proportional to the pixel area acquired. This allows much higher frame rates, if the area captured can be reduced. In the case of having a large potential area where the ball may be struck, such as 24"×12", knowing where the ball will actually be struck may allow capturing an area ¼ to 1/16 in size. This allows a 4-16 times faster frame rates, which allow conventional 15-60 fps sensors to be used to capture club swing events. Note that in many cases there is a setup time for the sensor acquisition area of interest to be setup. This time is available however in the golfing application, where the ball must be stationary to be hit. In the application to baseball the field of view could for instance be restricted to a hitting zone around the plate. If a strobe is used with a silhouette approach it is difficult to distinguish the club head in each shot.

Direct Illumination—The club area can be illuminated with light and cameras positioned to acquire the specular reflection of the light. Structured light can be used to produce a pattern which allows 3-D determination of the club face. The range of materials and shapes of clubs makes it difficult to acquire good data from all types of clubs with one setup.

Smear Approach—The field of view of a camera is lit with constant illumination, which exposes the image continuously. The resulting smears then represent the flight of the ball and the movements of the markings on the ball represent the spin axis and rate. A strobe needs to be fired at a constant rate to produce bright timing marks in the image to allow accurate timing information. Alternately a strobe light can be used which is normally on, with short intervals of Off which allow timing to be computed. If the frame rate is sufficient then an exposure which stops before the end of frame would produce gaps in the image which would allow velocity to be found. The marks on the ball now have the requirement that they produce a distinctive pattern as they smear with the rotation of the ball. Similarly the club movement can be captured as a smear, either in positive form or as a silhouette of the club. Depending on the 3-D relationship between the club face and the cameras, the edges in several cameras in the silhouette can describe the 3D movement of the club face. A setup will be needed which works for the range of clubs used, and allows the cameras unobstructed views of the club.

Silhouette Approach—If a screen is stretched across the front, side or back of the tee area and illuminated in visible or IR, the passage of the ball or club can be measured by processing the shadow cast by the ball or club on the image sensor. The shadow can be from an exposure short enough to freeze the motion of the objects, or if longer create a smear. The internal features of the ball cannot be determined.

Silhouette of the club—With a 3-D model of the club being used the silhouette created by it from enough cameras will allow the reconstruction of the path of the face of the club. The cameras will need to be positioned so that critical edges of the club are visible at some points in the swing. The 6-axis position of the club face is reconstructed from the various edges in the silhouette. The camera can be filtered to maximize the effect of the wavelength of the illumination. For a green background (grass colored) a green notch filter will have the desired effect in the visible spectrum. For IR illumination there are materials which produce diffuse illumination independent of their color in the visible. Olefin carpet is an example of this property. The grass colored mat would be 'doped' with this material so that it would produce diffuse IR illumination from when illuminated with IR light. This turns the hitting area into a backlight to silhouette the club and ball. Note that the angle the camera makes to the trajectory of the movement determines the intensity of the silhouette images with long exposures.

Club Model Determination—The club model is its geometry and other properties such as mass distribution. The 3-D cameras and possibly a weight sensor are used to capture and derive these values. Alternately the cameras can be used to identify the club used, and its properties taken from a database of club properties. The user may also simply enter the values needed. With the silhouette approach a club acquisition sequence would need to be added so that the club being used is determined, which allows its geometry and properties to be either read from a database or determined by club parameter determination operation. The club parameters are determined by moving the club through the field of view of the cameras in various directions which a club geometry finding program is running. In addition the club mass distribution could be determined by hitting a weight shift sensor with the club from several directions with a club mass distribution program running, once the club geometry is known. The portion of the club striking the surface of the weight shift sensor may need to be known, requiring for instance first the club to be struck with the bottom face, then toe, then heel, then opposite the face.

Shadow Approach—If the scene behind the club from the camera view is dark, and illumination comes from the general direction of the camera, with some offset, then the club will cast a shadow behind the club. The shadow can be from an exposure short enough to freeze the motion of the objects, or if longer create a smear. This approach can be used in concert with getting a normal image of the ball. The shadow contains no internal features, but does contain information about the position of the ball, assuming that the light and camera positions are known.

3-D VISION SIMULATOR SYSTEM—includes: Ball Data System; Putting System; Club System; Swing System; and Wide Angle Camera.

Swing System—Two or more cameras which acquire the information from the various areas of the simulator combined with lighting to highlight the various objects.

Wide Angle Camera—A camera is added which surveys are wide area from the top of the simulator. It is calibrated to simulator coordinates and synced with simulator time. Observations are extracted from this camera and used for several purposes:

They can be used to provide additional observations if the higher resolution cameras fail to have enough. This can happen on shots which are way off.

Get initial ball position and time of strike.

Get club data such as horizontal launch angle and club velocity.

Capture putting information from anywhere in the field of view

The wide angle camera is calibrated and can use either continuous illumination or strobe illumination. The images are captured and stored, with the state of the simulator and the results from the primary ball data system used to guide any processing of the images. The ball initial position is found by finding the ball image in the hitting area of the image when the system is armed. The height of the ball is determined by the position of the ball in the hitting area, where the height in found in advance. In addition the system is told whether this is a tee shot or not. The initial height and position of the ball can also be found from the primary 3-D launch cameras, with the relationship between the initial position of the ball in this camera being used along with a ball impact model to determine the height of the ball accurately.

The timing of the ball hit, along with the club data is found first. The image of the ball and the club is extracted. The ball is extracted directly, with the club being extracted as a silhouette against the ground background. This camera may be filtered to enhance contrast of the green background, or the background may an IR diffusing material which is illuminated with IR.

The club position is found at at least 3 positions centered on the initial ball position. The ball initial position, 3-D launch angle and 3-D velocity is known for purposes of finding the club velocity and horizontal launch angle. These positions are then fit to a model of club head movement consistent with this data to find the club head velocity before and after the ball strike, along with horizontal launch angle.

For putting the camera simply acquires images of the ball in the area of the initial putting position. The ball is moving quite slowly. At least 2 images are obtained which allows finding the speed and horizontal launch angle of the putt.

A critical approach with this camera to increase its speed is to take advantage of the known initial position of the ball and center a much smaller acquisition of the image on it. This allows the frame rate to increase by for instance 2 times, if only ⅓ of the area is acquired. Most image sensors allow this capability, sometimes only in one direction though.

The camera must be oriented to allow the entire length of the sensor to be in the ball flight direction. The width of the acquisition is reduced as much as possible for speed, but large enough to allow typical club and ball angles.

Additional information used: Simple Club Data; Putting Data; Wide Shot data; and Additional FOVs for increased accuracy and coverage.

Simulation of the Simulator—A simulator is created which simulates the 3-D volume of the simulator. It contains models of the cameras and lights, along with a ball flight model, golfer, golf swing. It allows the adjustment of the setup of the cameras and lights, along with changes to the layout of the simulator. It saves the simulation initial conditions. It produces sets of images from sample shots. It allows viewing of possible collisions and distances between objects. It is setup to allow the introduction of various noise and error conditions which degrade the images. It can be used to setup cameras and lights and determine final positions given a specific simulator configuration. These positions can then be used to fabricate mounting for the cameras and lights. It allows the automatic testing of ball marking systems, with the analysis of the expected results versus found results.

Figure 9A:
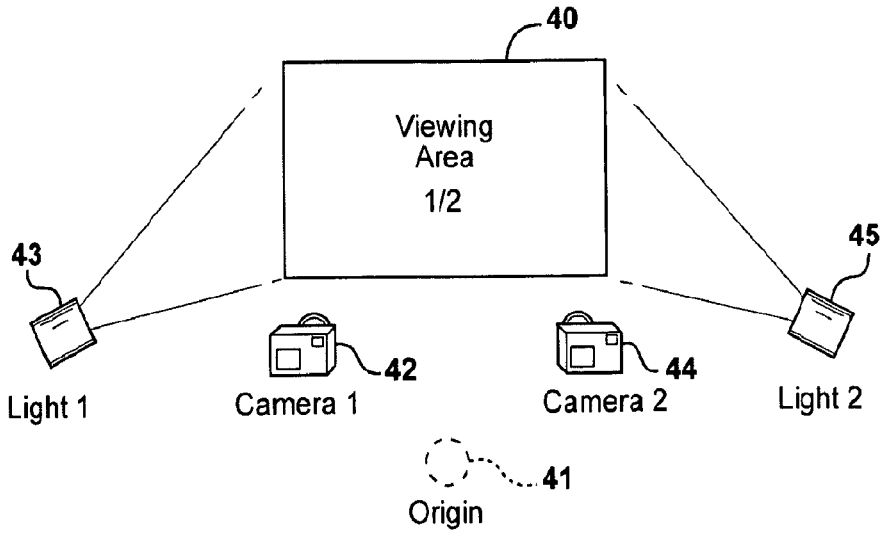
FIGS. 9A and 9B are schematic plan views of a simulator according to the present invention.
Figure 9B:
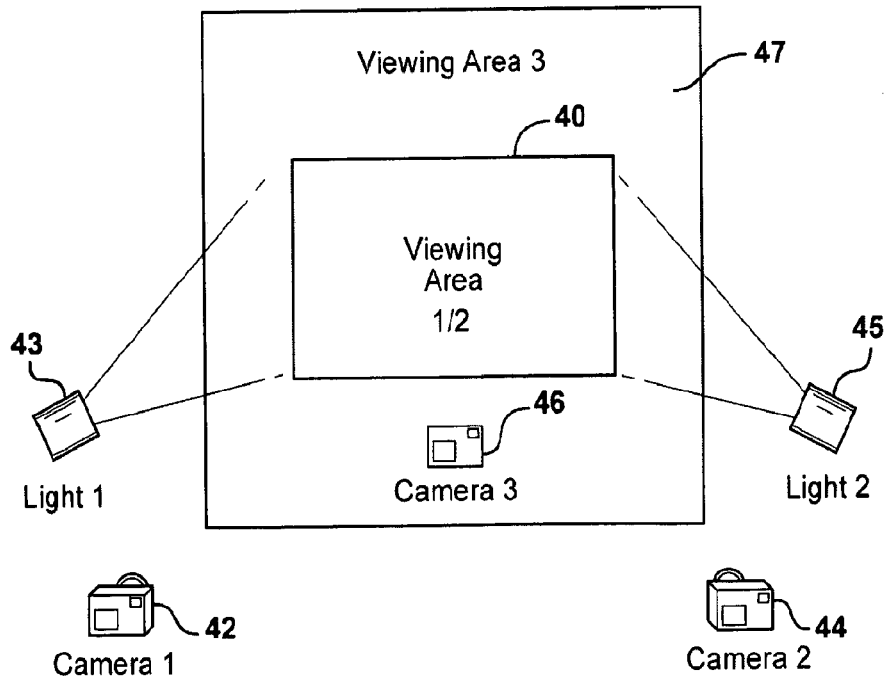
Figure 10:
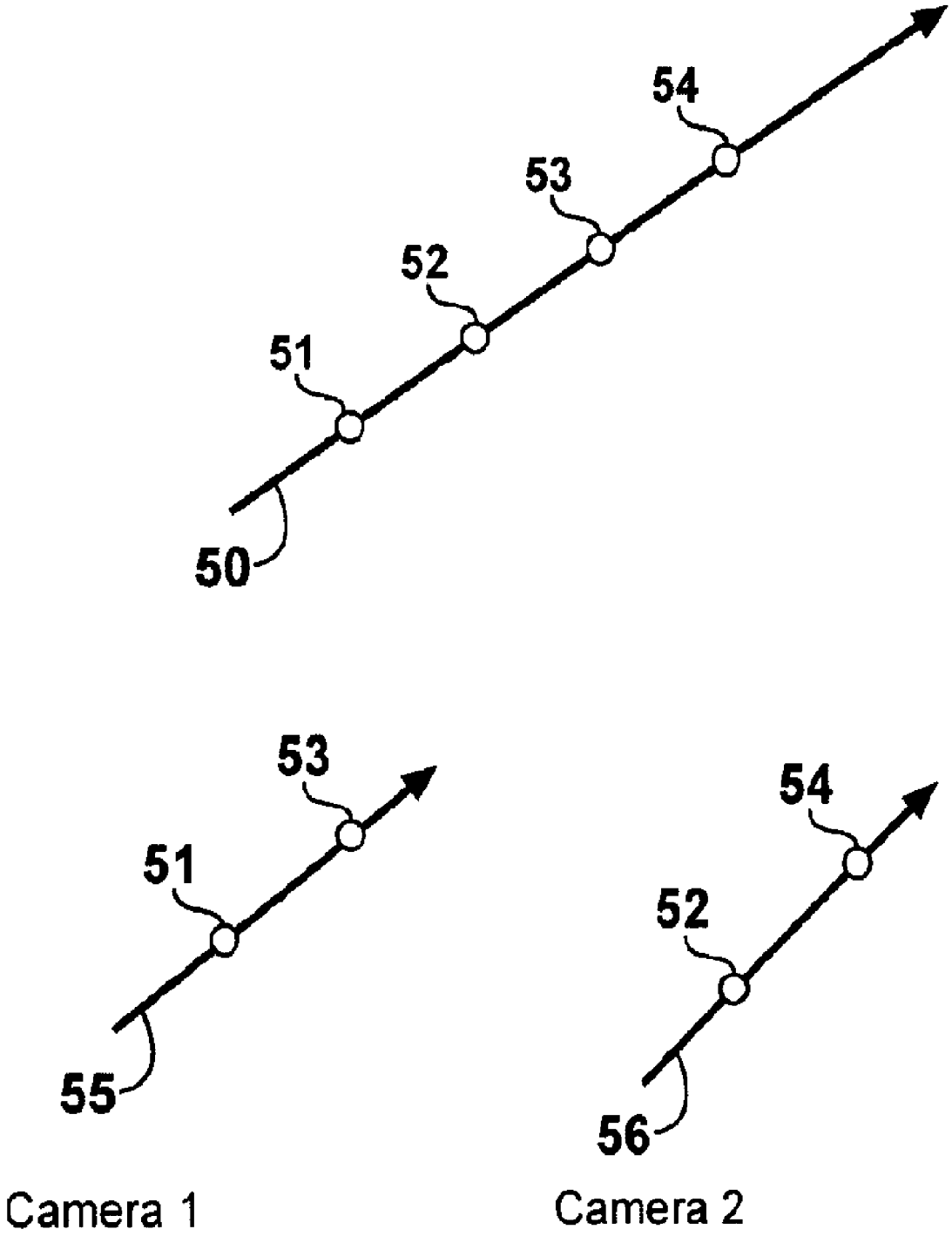
FIG. 10 is a schematic view of a 3-D trajectory of a ball.

The optimal light/camera geometry can be determined with repeated runs on the simulator evaluating various positions. Camera/light positions of the simulator are shown in FIGS. 9A and 9A. In FIG. 9A, a viewing area 40 observed with respect to a point of origin 41 by a first camera 42 cooperating with a light 43 and a second camera 44 cooperating with a light 45. In FIG. 9B, a third camera 46 is added to observe a viewing area 47 encompassing the viewing area 40. A 3-D trajectory 50 of a ball is shown in FIG. 10. The first camera 42 acquires images at points 51 (time 1) and 53 (time 3) along a first trajectory 55 line. The second camera 44 acquires images at points 52 (time 2) and 54 (time 4) along a second trajectory 56 line. This information is combined to generate the 3-D trajectory line 50.

Sports Simulation Game Air Environment Capture and Simulation—There are several elements of this system:

A model of the terrain which includes elevation.

Extensions of the terrain which allow local wind speed to be modeled based on the terrain.

An air flow model which takes terrain into account in finding the actual air flow for a given position.

An air flow model which uses an average wind speed number or weather conditions to model the air flow around terrain features. Such as hills, rivers, hills with trees, ocean breezes, etc.

An air flow model which takes into account season, weather conditions, and time of day. A model which allows a table to recreate air flows on the order of 10 s of meters.

A table of measured flow values is created which correspond to a position and elevation which provide an input to create an air flow value given current conditions. An encoding scheme allows the flow patterns to be stored efficiently. A device measures wind speed and direction in a 1 meter area. Various areas are sampled to allow the creation of an air flow chart for a specific time, seasons, weather conditions. Additional sets of wind speed are created. They are compared to the predicted air flow given by the model for the position and conditions indicated. The deviations from the model are recorded if they are large enough. Wind speed variation and direction is modeled based on position and conditions. Measurements are made of wind speed and direction at real locations and at specified conditions. Corrections to the model are computed and stored to allow recreation of the wind speed and direction under a specific set of conditions.

The wind speed and direction is represented as an animation showing the possible effect given various ball flights through it. The effect on ball speed and direction given the ball parameters is modeled and show graphically. This is an extension of current sporting event simulation, which allows the more accurate use of ball flight models in simulating ball flight outcomes.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A system for collecting and analyzing data related to a ball in flight comprising:

at least one camera for recording images of a flight of a ball in a viewing area; and a control means connected to and controlling the at least one camera to record an image of the ball entering an initial portion of the viewing area and the control means responding to the image of the ball in the initial portion of the viewing area for predicting another portion of the viewing area in which to obtain an image of the ball with the at least one camera or another camera connected to the control means;

wherein the ball is unmarked and the control means computes a trajectory of the ball using a ball flight model and a ball spin calculated from images of the ball in the viewing area;

wherein the control means computes the trajectory by:

obtaining a first plurality of images of the ball from the at least one camera during an initial first segment of the ball flight;

determining from the first plurality of images a best fit first curve with an initial velocity and launch vector;

projecting the ball trajectory through a second segment of the ball flight using the best fit initial velocity and launch vector in the ball flight model;

using the ball flight model to generate a series of ball trajectory curves with various spin rates and spin axes;

obtaining a second plurality of images of the ball from the at least one camera or another camera during the second segment of the ball flight;

using the first plurality of images and the second plurality of images to obtain a best fit second curve; and one of a) comparing the ball trajectory curves that fit the best fit first curve with the best fit second curve and selecting one of the ball trajectory curves that minimizes an area between the compared curves and b) determining a maximum deviation of the best fit second curve from one of the flight model ball trajectory curves having a zero spin at a given time and selecting one of the ball trajectory curves closest to the maximum deviation as indicating a spin rate of the ball.

2. The system of claim 1 wherein the control means predicts the another portion of the viewing area by analyzing two images of the ball at different positions in the initial portion of the viewing area.

3. The system of claim 1 wherein the control means processes multiple images from the at least one camera to obtain data related to: ball trajectory including ball launch angle, ball velocity and ball spin; a swing monitor; a launch monitor; a putting profiler; a ball finder, and an automated performance enhancement.

4. The system of claim 1 wherein multiple cameras or a high speed camera is used in conjunction with a strobe light or infrared illumination to obtain the images in the viewing area.

5. The system of claim 1 wherein a golfer's motion profile, a swing set profile and a skeletal motion can be analyzed and improved by the control means.

6. The system of claim 1 wherein the ball is unmarked and the control means computes a spin of the ball by locating and correlating sub-images of individual dimples in the images of the ball during the ball flight.

7. A system for collecting and analyzing data related to an unmarked ball in flight comprising:

at least one camera for recording images of a flight of an unmarked ball in a viewing area; and a control means connected to and controlling the at least one camera to record an image of the ball entering an initial portion of the viewing area and the control means responding to the image of the ball in the initial portion of the viewing area for predicting another portion of the viewing area in which to obtain an image of the ball with the at least one camera or another camera connected to the control means, wherein the control means computes a trajectory of the ball using a ball flight model and a ball spin calculated from images of the ball in the viewing area by:

obtaining a first plurality of images of the ball from the at least one camera during an initial first segment of the ball flight;

determining from the first plurality of images a best fit first curve with an initial velocity and launch vector;

projecting the ball trajectory through a second segment of the ball flight using the best fit initial velocity and launch vector in the ball flight model;

using the ball flight model to generate a series of ball trajectory curves with various spin rates and spin axes;

obtaining a second plurality of images of the ball from the at least one camera or another camera during the second segment of the ball flight;

using the first plurality of images and the second plurality of images to obtain a best fit second curve; and one of a) comparing the ball trajectory curves that fit the best fit first curve with the best fit second curve and selecting one of the ball trajectory curves that minimizes an area between the compared curves and b) determining a maximum deviation of the best fit second curve from one of the flight model ball trajectory curves having a zero spin at a given time and selecting one of the ball trajectory curves closest to the maximum deviation as indicating a spin rate of the ball.

* * * * *